United States Patent [19]

Lindeborg

[11] 4,040,571

[45] Aug. 9, 1977

[54] METHOD OF CONVEYING AND DESINTEGRATING REFUSE AND THE LIKE, AND APPARATUS FOR CARRYING OUT THIS METHOD

[75] Inventor: David Georg Lindeborg, Blomstermala, Sweden

[73] Assignee: Norba Aktiebolag, Blomstermala, Sweden

[21] Appl. No.: 724,309

[22] Filed: Sept. 17, 1976

Related U.S. Application Data

[63] Continuation of Ser. No. 571,518, April 25, 1975, abandoned.

[30] Foreign Application Priority Data

May 3, 1974 Sweden ..... 7405908

[51] Int. Cl.[2] ..... B02C 19/22

[52] U.S. Cl. ..... 241/30; 241/36; 241/135; 241/235; 241/260.1

[58] Field of Search ..... 241/30, 33, 36, 135, 241/141, 142, 143, 146, 220, 221, 224, 225, 260.1, 235

[56] References Cited

U.S. PATENT DOCUMENTS

| | | | |
|---|---|---|---|
| 461,789 | 10/1891 | Winchell | 241/235 X |
| 529,907 | 11/1894 | Hickman | 241/260.1 X |
| 2,843,330 | 7/1958 | Gundlach | 241/235 |
| 3,524,597 | 8/1970 | Burden, Jr. et al. | 241/142 |
| 3,822,042 | 7/1974 | Roy | 241/260.1 |

*Primary Examiner*—Granville Y. Custer, Jr.
*Attorney, Agent, or Firm*—Hubbell, Cohen, Stiefel & Gross

[57] ABSTRACT

Method and apparatus for conveying and disintegrating refuse and the like comprising a plurality of mutually cooperating, rotatable feed screws arranged in a common feeding-in chamber. The direction of rotation of at least one of said screws is intermittently reversed relative to at least one other of said screws according to a predetermined program for temporarily feeding part of said refuse backwards.

9 Claims, 6 Drawing Figures

METHOD OF CONVEYING AND DESINTEGRATING REFUSE AND THE LIKE, AND APPARATUS FOR CARRYING OUT THIS METHOD

This is a continuation of application Ser. No. 571,518, filed Apr. 25, 1975, now abandoned.

SUMMARY OF THE INVENTION

Existing devices of this kind are bulky, costly, and require extensive manual service.

As a result there is an ever increasing need for an efficient machine for reducing the piece size of refuse to make it easier to mix with other materials, such as bark, saw dust or the like, before being deposited upon a refuse dump or before being fed into a garbage combustion furnace or the like.

Accordingly, the principal object of the invention is to make possible and facilitate the conveyance of larger objects, such as doors, fiber boards, crates and the like between the screw flights in a manner which has not heretofore been possible.

This and other objects are attained thanks to the fact that at least one of the feed screws is intermittently rotated in a direction opposite to its normal direction of rotation according to a predetermined program, for temporarily feeding part of the refuse or the like backwards, resulting in increased efficiency in the disintegration of said refuse.

In concert herewith, the apparatus, according to the invention, is primarily characterized by the provision of preferably electric or electrical means for intermittently reversing the direction of rotation of at least one of said feed screws with respect to its normal direction of rotation according to a predetermined program, for temporarily feeding part of the refuse or the like backwards.

Thanks to the invention, a very great movement and moving about of the larger objects is attained with the result that said objects are more easily caught by the screw flights. Furthermore, a screw flight which rotates backwards lifts up pieces of refuse which have got stuck in the bottom of the feeding chamber. The invention also prevents jamming of the screws. In addition, a more complete disintegration of the larger pieces is attained due to the fact that the conveyance of the individual pieces of refuse through the apparatus takes a longer time as a result of the intermittent feeding backwards of said refuse.

Further features and advantages of the method and the apparatus according to the invention will become apparent from the following detailed description and annexed drawings, which diagrammatically and as a non-limiting example illustrate an embodiment of the invention preferred at present.

DETAILED DESCRIPTION OF PREFERRED EMBODIMENTS

Figure 1:
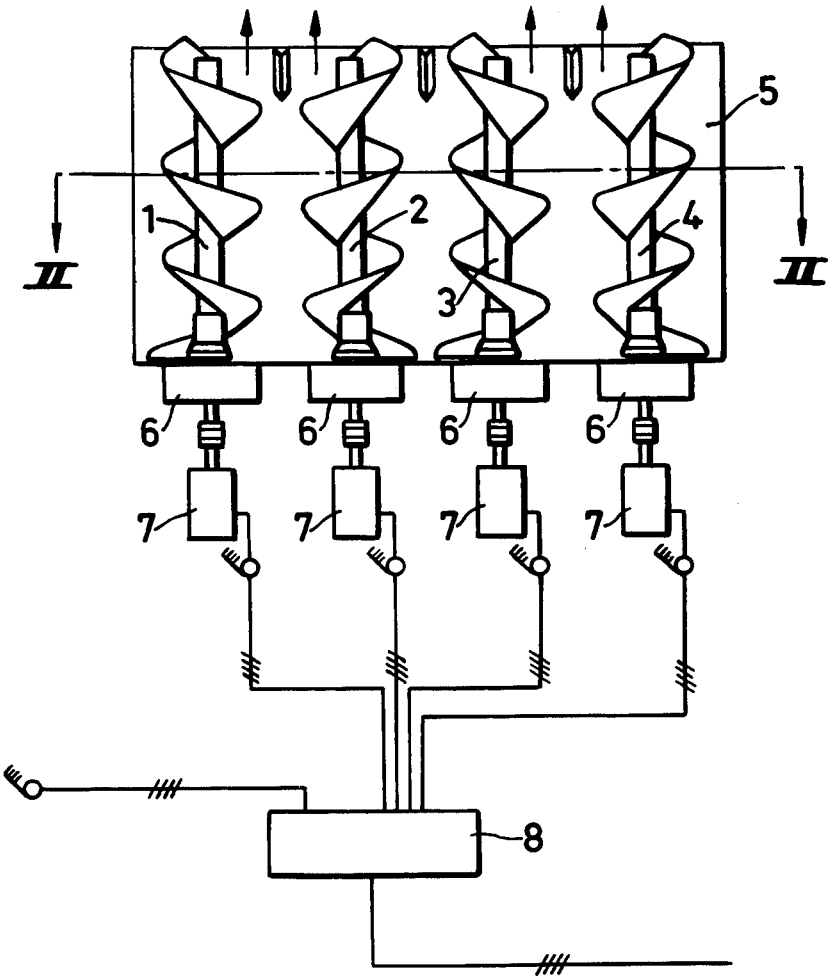
FIG. 1 is a diagrammatic plan view of an apparatus according to the invention.
Figure 2:
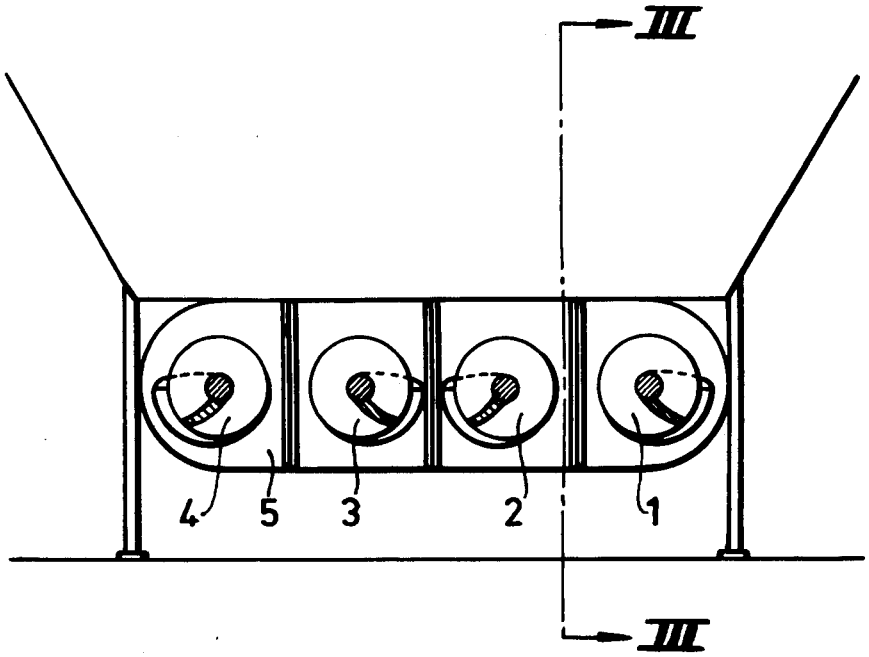
FIG. 2 is a cross sectional view, substantially on line II—II in FIG. 1.
Figure 3:
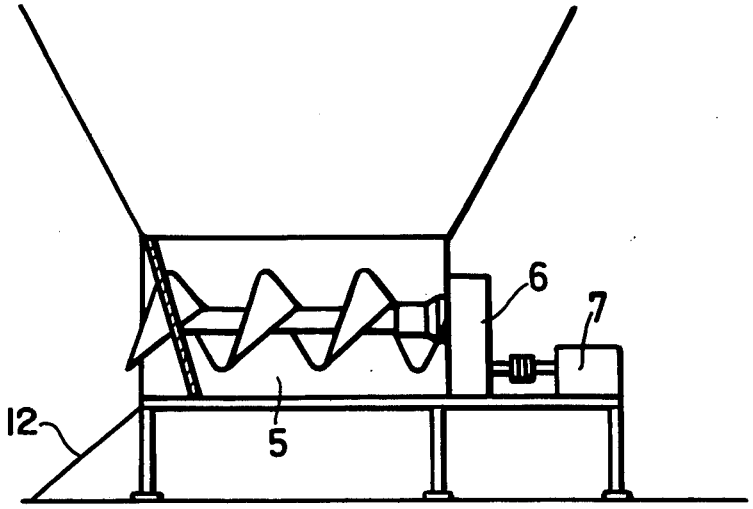
FIG. 3 is a longitudinal section substantially on line III—III in FIG. 2.
Figure 4:
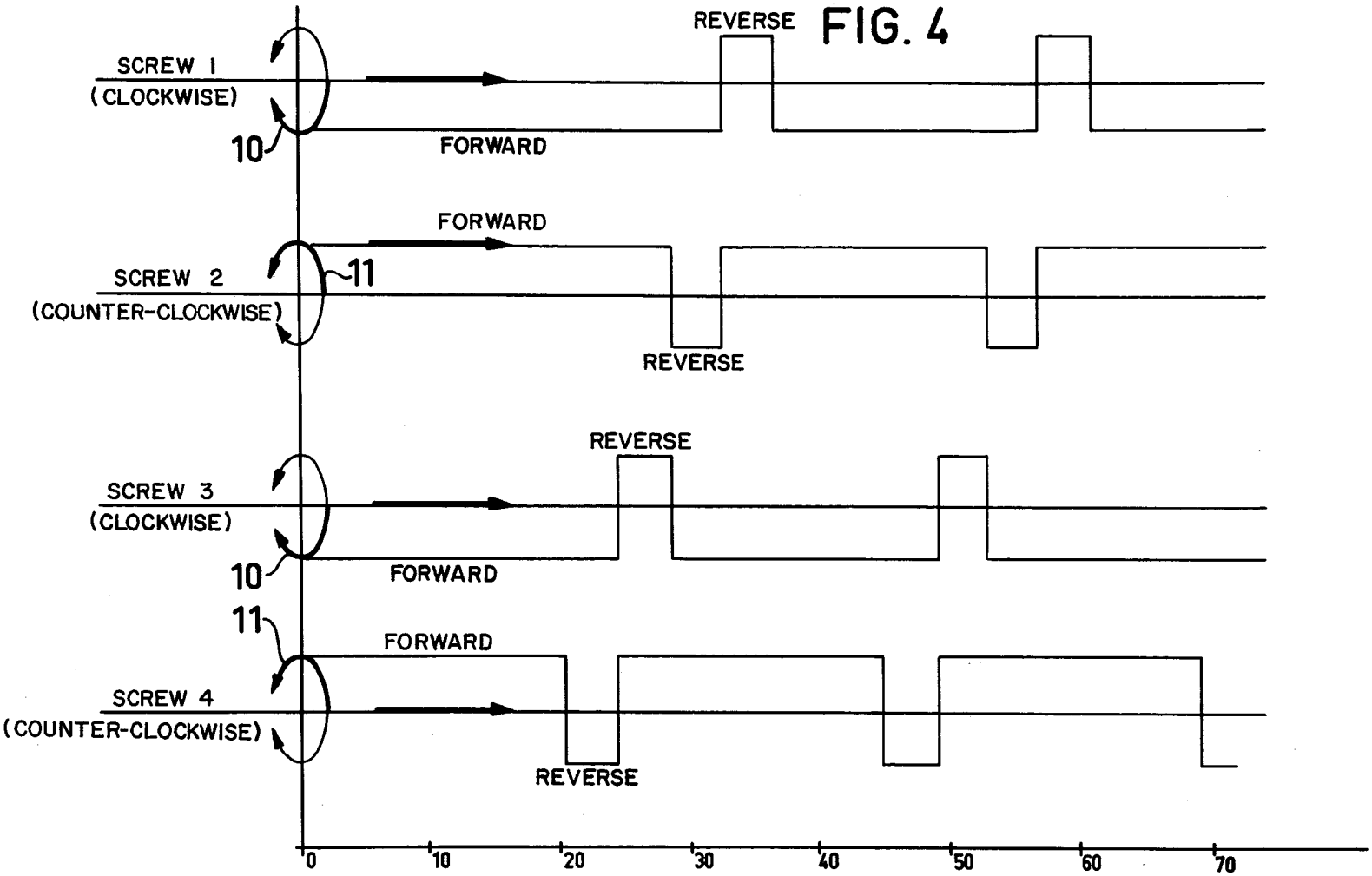
FIGS. 4 and 5 illustrate examples of different programs or movement diagrams of the four screws shown in FIG. 1.
Figure 5:
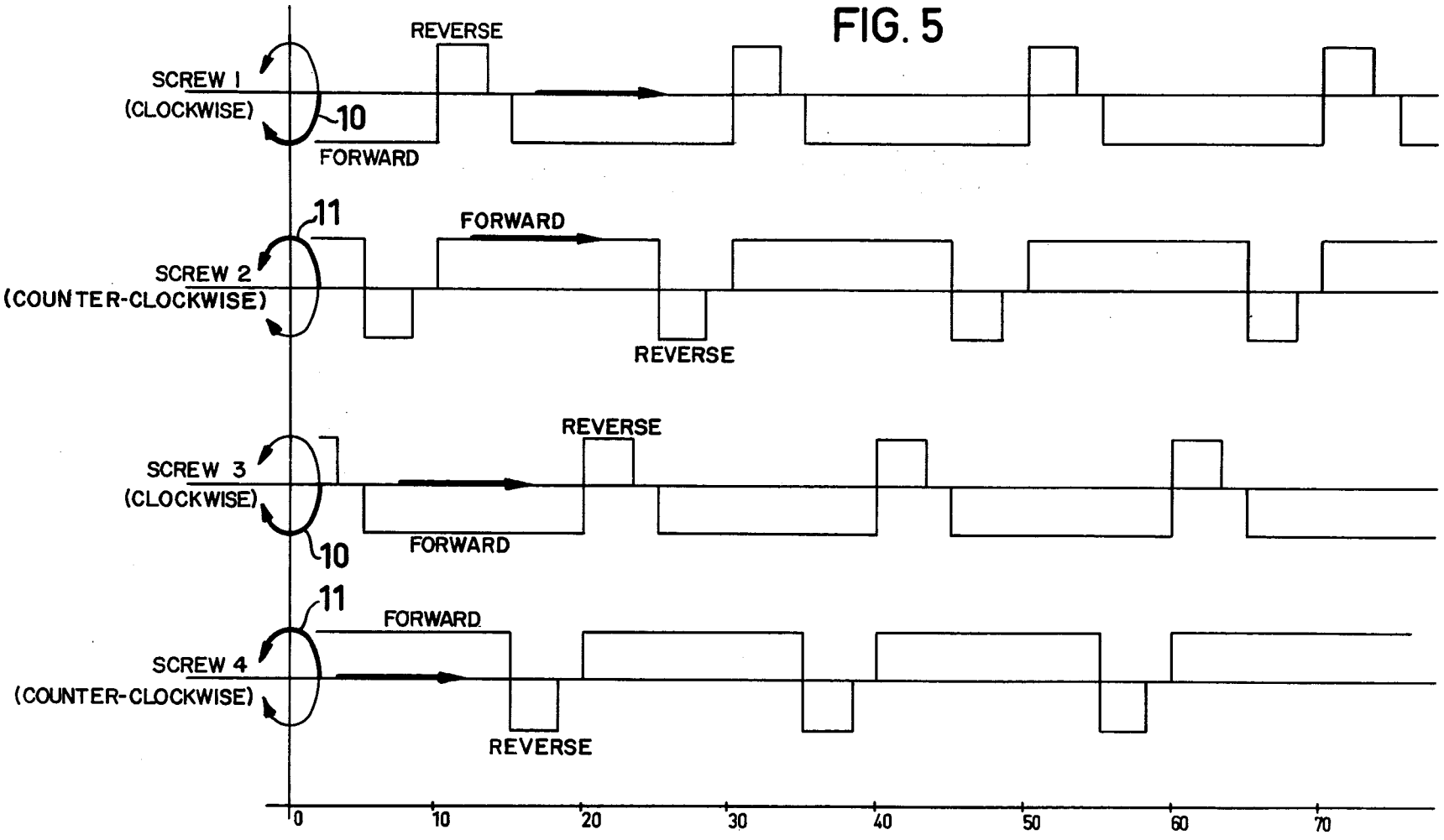

In the drawings 1 - 4 designate the conveying and disintegrating screws, of which 1 and 3 are right-hand screws, i.e. advance the refuse when being rotated in a clockwise direction indicated by the arrows 10 in FIGS. 4 and 5, and the screws 2 and 4 are left-hand screws, i.e. advance the refuse when being rotated in a counterclockwise direction of rotation indicated by the arrows 11. As shown in FIG. 1, the screws 1 - 4 are arranged in a common feeding-in chamber 5 and are each driven by an individual electric motor 7 through gear boxes with bearings 6 in the illustrated embodiment. The screws feed out the waste or refuse, which has been disintegrated and to a certain extent also compressed into a feed chute or the like 12 shown in FIG. 3. The drive motors 7 are powered by an ordinary three-phase network and controlled through programming or timing means, provided in a casing for electrical equipment 8.

According to the invention, each cycle of operation in the program comprises, for at least one of the screws a forward motion, i.e. advancement of refuse, plus a backwards motion, i.e., feeding back of refuse, the forward motion being for a preferably longer interval than the backwards motion. Screws 1 - 4 preferably have substantially the same cycle of operation, the cycles of operation of the individual screws, however, being mutually out of time phase. Alternatively, the periodicity of the cycles of operation of screws 1-4 may be different. The above statement that at least one screw is intermittently rotated backwards is intended to encompass the situation where the rotation of said screw is temporarily stopped relative to the chamber.

FIGS. 4 and 5 illustrate two examples of motion diagrams for screws 1-4 in the form of time diagrams.

According to FIGS. 4 and 5, the time for run forwards of screws 1-4 is considerably longer than the time for run backwards, i.e. of the magnitude of 30 - 240 seconds and about 6 seconds, respectively. The speed of rotation of said screws may be 10 - 15 rev./min., forwards as well as backwards, which means that a reversed screw will rotate at least one complete revolution backwards. In FIG. 4 the transition from run forwards to run backwards occurs without any time delay. In FIG. 5, a stop is interposed between run backwards and run forwards. It is, however, obvious that a similar stop could be interposed in the transition between run forwards and run backwards, as a supplement to or instead of the first-mentioned stop.

Figure 6:
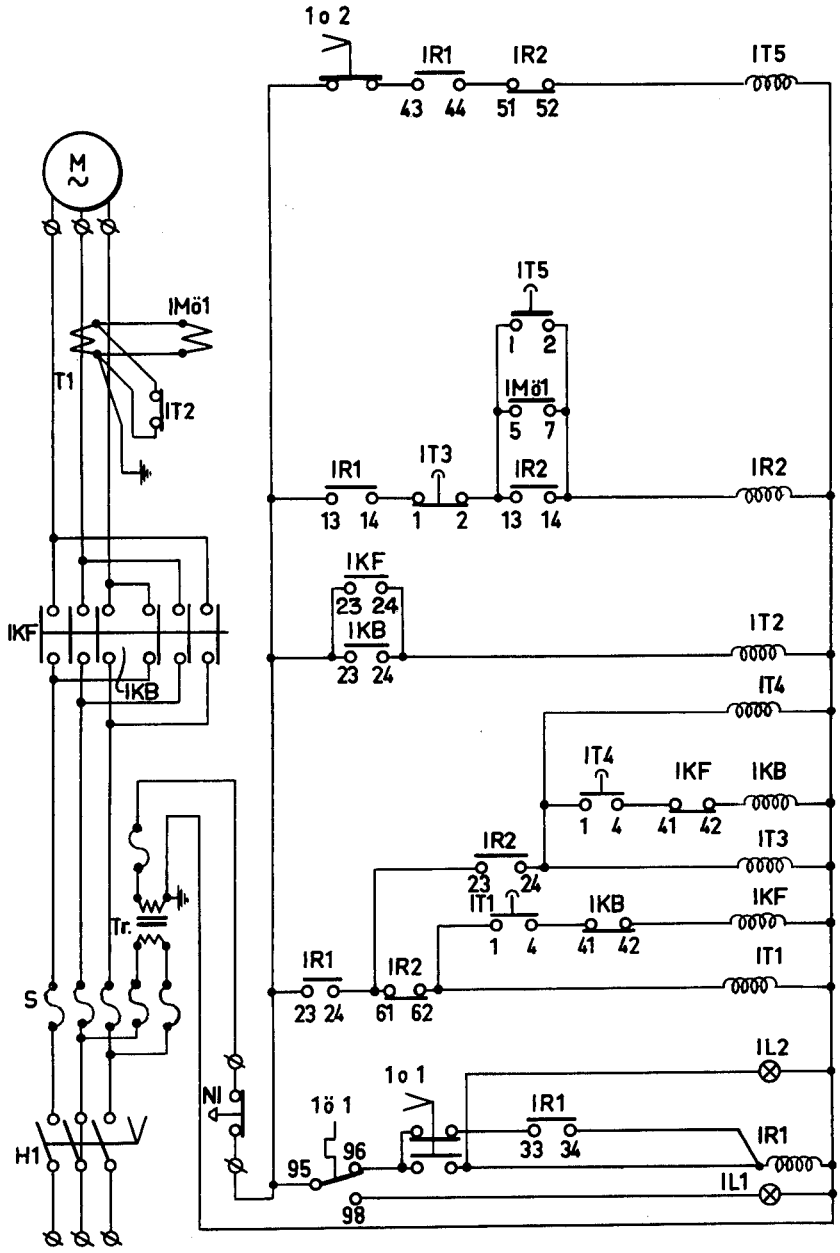
FIG. 6 is a diagram illustrating the electrical equipment associated with one screw necessary for performing a given program.

A diagram showing possible electrical means for the operation of one screw to accomplish the intermittent reversal of its direction of rotation once every cycle of operation is illustrated in FIG. 6. This diagram is doubled for two screws and so on. In this diagram R designates a relay, K a contactor, B backwards, F forwards, L a lamp and T time. H1 is a main switch, S designates fuses, Tr an auxiliary transformer, Nl an emergency stop breaker, Tl a current transformer, 1 Mö 1 an overcurrent relay, 1 o 1 a start switch, 1 ö 1 a bimetal switch and 1 o 2 a control switch, by means of which the ordinary (automatic) backward movement can be disconnected if desired. Lamp 1L1 indicates a current overload when bimetal switch 1ö1 is operated to open contacts 95–96 and close contacts 95–98, and lamp 1L2 indicates that motor M is operating.

The remaining designations will be apparent from the diagram.

Contacts, which are shown in their closed position, such as 1R2 61–62 (compare point 3 in page 4) are break contacts. The other contacts, such as 1R1 13–14, which are shown in their open position, are make contacts. A contactor or relay winding, such as 1R1, operates or controls all make and/or break contacts having the same designation (1R1).

The electrical equipment operates as follows:

1. Main switch H1 is closed.

2. Start is made by 1 o 1, manually, which has the consequence that 1R1 is energized and gets self holding by 1R1 33-34.

3. 1R1 23-24 closes the circuit to timing relay 1T1 across break contacts 1R2 61-62.

4. The time set on timing relay 1T1 energizes contactor 1KF and the screw rotates "forward".

5. The screw rotates "Forward" until the time set on 1T5 which has been actuated by 1R1 43-44, expires, when 1R2 is energized through 1R1 13-14, 1T3 1-2 and 1T5 1-2, the circuit to 1T4 then becoming closed through 1R1 23-24 and 1R2 23-24 and the circuit to 1KF becoming opened at contact 1R2 61-62.

6. When the time of 1T4 expires, which constitutes a time delay between run forwards and run backwards, the circuit of 1KB is closed through contact 1T4 1-4 and contact 1KF 41-42, so that 1KB is energized with the consequence that the screw starts running "Backward".

7. After the "Reverse Time" set on 1T3, 1T3 1-2 opens the circuit for relay 1R2 and the movement backwards is stopped via 1R2 23-24, a new start then being initiated through 1R2 61-62.

When the screw is overloaded, the momentary overcurrent relay 1 Mö 1 is energized, and the contact 1 Mö 1 5-7 closes the circuit for 1R2, which is energized through 1R1 13-14, and so on according to points 5, 6 and 7 above. The purpose of 1T2 is to make 1 Mö 1 insensitive to the start current of the motor.

The embodiment described above and illustrated in the drawings are, of course, to be regarded merely as a non-limiting example and may as to its details be modified in several ways within the scope of the following claims. In particular, the illustrated movement diagrams or programs for the intermittent reversal of the direction of rotation of the screws as well as the equipment therefore may be varied almost infinitely with the use of electronic and/or purely mechanical means. Furthermore, it is possible to drive all screws by one single common drive motor, which is governed by electronic equipment comprising one single unit and to which the individual screws are coupled by suitable power transmissions. Of course, the apparatus according to the invention may be used for feeding or conveying materials other than waste or refuse.

What I claim is:

1. Method of conveying and disintegrating composite goods such as refuse comprising the steps of (1) advancing said goods through a chamber by rotating in said chamber a plurality of mutually cooperating, substantially parallel rotatable feed screws which define therebetween axially extending interspaces, said rotation being in the axial direction of said feed screws; and (2) cyclically intermittently reversing the direction of rotation of at least one of said feed screws relative to at least one other of said feed screws according to a predetermined program, whereby to temporarily feed part of the goods backwards.

2. Method according to claim 1, in which each of said feed screws is rotated relative to said chamber according to the same cycles of movement, which cycles are mutually out of time phase.

3. Method according to claim 1, wherein each of said feed screws has a forward and reverse direction of rotation relative to said chamber and wherein the rotation of each of said feed screws relative to said chamber is stopped each time it reverses from said reverse to said forward direction and is then started in the forward direction at a selected time interval thereafter.

4. Method according to claim 1, in which the cycle of movement of each of said feed screws relative to said chamber is different from the cycle of movement of each other of said feed screws relative to said chamber.

5. Method according to claim 1, wherein each of said feed screws has a forward and reverse direction of rotation relative to said chamber and wherein the duration of time during each cycle of movement in which each of said feed screws rotates in the reverse direction is about 1/40–1/5 of the time in which each of said feed screws rotates in the forward direction.

6. Method according to claim 1, in which at least two of said feed screws are cyclically intermittently and individually reversed at different times relative to said chamber.

7. Apparatus for conveying and disintegrating composite goods, such as refuse, comprising:

a. means defining a feeding-in chamber for said goods; a plurality of mutually cooperating, substantially parallel rotatable feed screws in said chamber, said feed screws defining therebetween axially extending interspaces;

b. drive means for rotating said feed screws in their axial direction to thereby advance the goods in said direction; and c. means for cyclically intermittently reversing the direction of rotation of at least one of said screws relative to at least one other of said screws according to a predetermined program, whereby to temporarily feed part of said goods backwards.

8. Apparatus according to claim 7, wherein said drive means comprises an individual drive motor for each of said feed screws and individual control circuit means for each of said drive motors for rotating each screw relative to said chamber defining means according to its own predetermined program.

9. Apparatus according to claim 8, wherein each of said individual control circuit means comprises a means for reversing its associated drive motor for effectuating reversal, relative to said chamber defining means, of the direction of rotation of the associated feed screw upon the occurrence of an overload on said drive motor.

* * * * *